US006341658B1

(12) United States Patent
Rosenwald

(10) Patent No.: US 6,341,658 B1
(45) Date of Patent: Jan. 29, 2002

(54) MODULAR VEHICLE SYSTEM HAVING VARIABLE CONFIGURATIONS AND ITS ASSOCIATED METHOD OF ASSEMBLY

(76) Inventor: Greg Rosenwald, 1308 Meetinghouse Rd., Rydal, PA (US) 19046

( * ) Notice: Subject to any disclaimer, the term of this patent is extended or adjusted under 35 U.S.C. 154(b) by 0 days.

(21) Appl. No.: 09/611,049

(22) Filed: Jul. 6, 2000

Related U.S. Application Data

(63) Continuation-in-part of application No. 09/455,512, filed on Dec. 6, 1998, now abandoned.

(51) Int. Cl.[7] ..... A63C 17/12
(52) U.S. Cl. ..... 180/180; 180/11; 180/219
(58) Field of Search ..... 180/180, 19.1, 180/19.2, 19.3, 13, 11, 219, 220

(56) References Cited

U.S. PATENT DOCUMENTS

| | | | | |
|---|---|---|---|---|
| 770,936 A | | 9/1904 | Simpson | |
| 3,750,777 A | * | 8/1973 | Thompson | 180/19.1 |
| 3,797,446 A | * | 3/1974 | Cox et al. | 180/19.1 |
| 3,826,323 A | * | 7/1974 | Mehne | 180/9.22 |
| 3,876,032 A | | 4/1975 | Ferino | 180/9.2 R |
| 3,978,936 A | | 9/1976 | Schwartz | 180/31 |
| 4,096,919 A | * | 6/1978 | Thompson | 180/21 |
| 4,109,732 A | * | 8/1978 | Wright | 180/19.1 |
| 4,410,060 A | | 10/1983 | Cunard | 180/205 |
| 4,413,692 A | | 11/1983 | Clifft | 180/11 |
| 4,456,089 A | | 6/1984 | Kuwahara | 180/180 |
| 4,508,187 A | | 4/1985 | Wenzel | 180/181 |
| 4,546,841 A | | 10/1985 | Sipiano | 180/181 |
| 4,681,332 A | | 7/1987 | Malone | 280/87.02 R |
| 5,025,876 A | * | 6/1991 | Barnard | 180/7.1 |
| 5,141,067 A | | 8/1992 | Diggs | 180/11 |
| 5,222,569 A | * | 6/1993 | Martel | 180/180 |
| 5,368,122 A | | 11/1994 | Chou | 180/220 |
| 5,385,210 A | | 1/1995 | Harvey | 180/11 |
| 5,401,070 A | | 3/1995 | LePelley | 294/1.1 |
| 5,433,284 A | | 7/1995 | Chou | 180/205 |
| 5,562,176 A | | 10/1996 | Lucernoni et al. | 180/180 |

FOREIGN PATENT DOCUMENTS

| | | |
|---|---|---|
| GB | 2246751 A | 12/1992 |
| NO | 6690 | 5/1898 |

* cited by examiner

*Primary Examiner*—Michael Mar
(74) *Attorney, Agent, or Firm*—LaMorte & Associates

(57) ABSTRACT

A modular vehicle system consisting of a rear propulsion device and a variety of different front-end assemblies that can be attached to the rear propulsion device to create different types of motorized vehicles. The rear propulsion device contains a frame, an engine mounted to that frame and a drive wheel that is driven by the engine. The front-end assemblies contain a frame, a steering fork element and a steering mechanism for turning the steering fork element. The steering fork supports either a front wheel or a ski. The frame of the front-end assembly attaches to the frame of the rear propulsion device in order to create a vehicle upon which a person can sit. At any time, the front-end assembly can be exchanged with another of a different configuration in order to change the physical characteristics of the resultant vehicle.

7 Claims, 5 Drawing Sheets

MODULAR VEHICLE SYSTEM HAVING VARIABLE CONFIGURATIONS AND ITS ASSOCIATED METHOD OF ASSEMBLY

RELATED APPLICATIONS

This application is a Continuation-In-Part of U.S. patent application Ser. No. 09/455,512, filed Dec. 06, 1998, now abandoned entitled SYSTEM AND METHOD FOR PROPELLING A PERSON.

BACKGROUND OF THE INVENTION

1. Field of the Invention

In general, the present invention relates to low horsepower vehicular systems used to transport a single person. More particularly, the present invention relates to low horsepower vehicular systems that can be converted into different configurations for different purposes.

2. Description of the Prior Art

The first time man ever connected wheels to his shoes is long lost in history. Since that day, countless versions of skates, skateboards, scooters and like inventions have been developed that share the same basic idea. That idea being that it is fun and entertaining to propel yourself on a set of small wheels.

Since the very beginning of skates, people have sought ways to propel themselves on the skates, other than through physical exertion. For example, many a child has used the family dog to pull them on skates. Over the years, several people have developed motorized propelling systems that take the place of the family dog. Prior art motorized propelling systems typically have a wheel mounted to an elongated frame. The wheel is turned by a small gasoline engine. A person on skates is propelled by hanging on to the elongated shaft as the gasoline engine drives the motor.

Such prior art propelling systems come in two styles. In the first style, the motorized propelling system is positioned in front of a person and is used to tow that person. Such prior art devices are exemplified by U.S. Pat. No. 5,385,210 to Harvey, entitled Tow Vehicle System. Such systems are not very powerful because the weight of the person being pulled is not used to bias the drive wheel against the ground. Accordingly, when the ground is not smooth and level, such prior art devices tend to spin their wheels. Furthermore, since the person being propelled is being pulled, a person needs great strength in his arms to pull himself toward the motorized propelling system in order to maintain an upright position and maintain balance. Additionally, since the person using such a motorized device is being pulled, the motorized device is also used to steer. The skates on the person merely follow the direction of the motorized device.

Recognizing the disadvantages of motorized systems that pull a person, inventors have designed rear positioned propelling systems. In a rear propelling system, the motor and drive wheel are positioned behind the person being propelled. Consequently, the person is pushed by the propelling device. The weight of the person acts to bias the drive wheel against the ground. Accordingly, rear propelling systems have much better traction and power than do front propelling systems. Furthermore, the skates are now used to steer, since the skates are positioned in front of the rear propelling system. Examples of rear propelling systems can be found i in U.S. Pat. No. 4,456,089 to Kuwahara, U.S. Pat. No. 5,562,176 to Lucernoni and United Kingdom Patent Application GB 2246751 A to Kneale.

However, a disadvantage of the rear propelling system is that the frame of the propelling system extends between the legs of the person being propelled. Accordingly, a person using such a device is prevented from crossing his legs. This severely limits the movements of a person wearing in-line skates, wherein certain maneuvers require that a person cross his/her legs in order to successfully complete the maneuver.

Another problem with prior art propelling systems is that they only have a single configuration. As such, a person can only be propelled by such devices in a single manner. As such, some propelling devices only propel people who are wearing skates. Some prior art propelling devices only propel people who are on bicycles. However, prior art devices used for bicycle cannot be adapted for use by a person with skates and vice versa.

A need therefore exists for a rear motorized propelling system that can propel a person from the rear without extending through that person's legs or otherwise limiting the maneuverability of a person's legs. A need also exists for a rear motorized propelling system that is modular in construction and can be selectively reconfigured for different applications. These needs are met by the present invention as it is described and claimed below.

SUMMARY OF THE INVENTION

The present invention is a modular vehicle system consisting of a rear propulsion device and a variety of different front-end assemblies that can be attached to the rear propulsion device to create different types of motorized vehicles. The rear propulsion device contains a frame, an engine mounted to that frame and a drive wheel that is driven by the engine. The front-end assemblies contain a frame, a steering fork element and a steering mechanism for turning the steering fork element. The steering fork supports either a front wheel or a ski.

The frame of the front-end assembly attaches to the frame of the rear propulsion device in order to create a vehicle upon which a person can sit. At any time, the front-end assembly can be exchanged with another of a different configuration in order to change the physical characteristics of the resultant vehicle.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
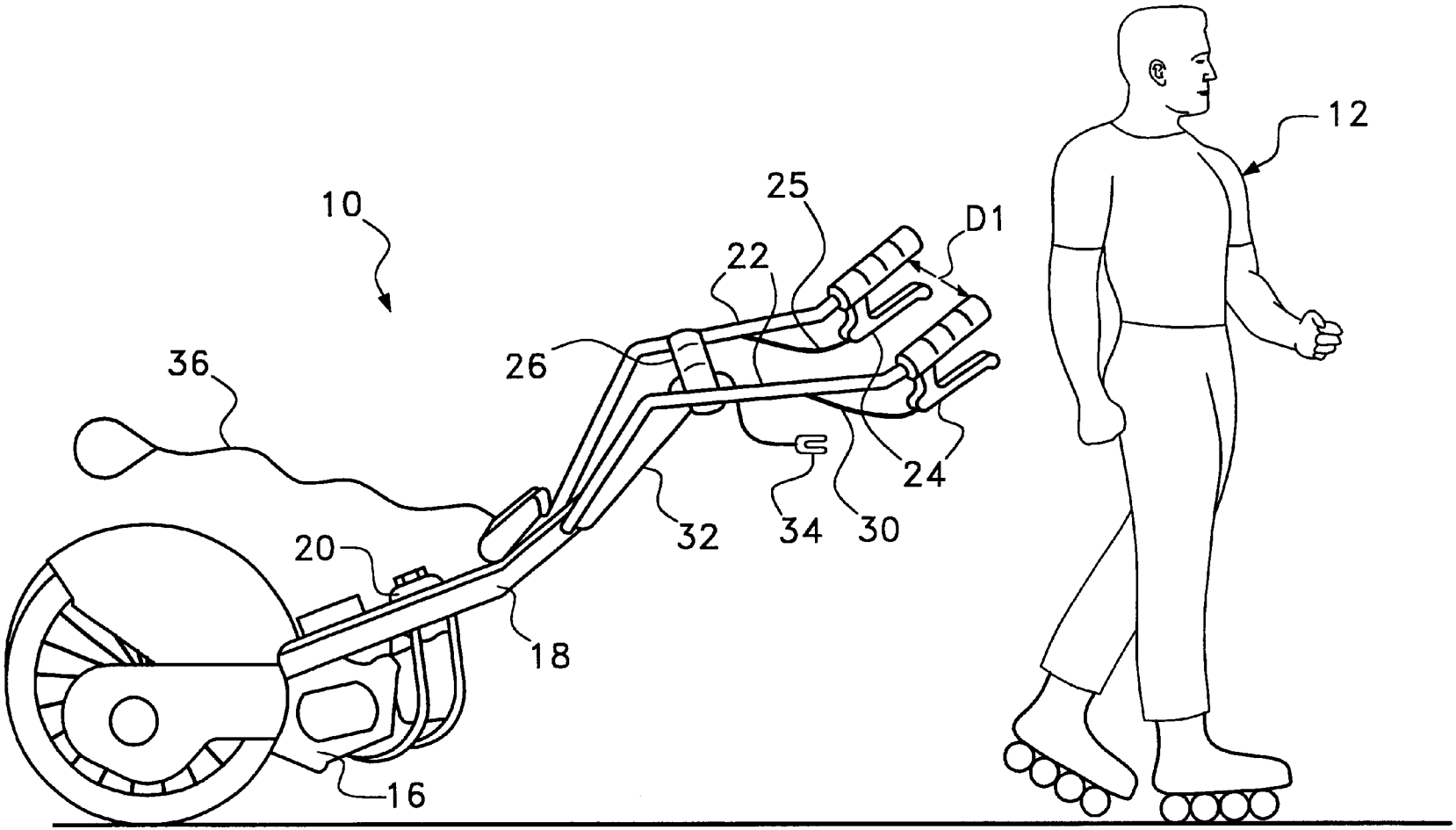
FIG. 1 is a perspective view of an exemplary embodiment of a rear propulsion device, shown in conjunction with a person wearing in-line skates.

Referring to FIG. 1, a first embodiment of the present invention propulsion assembly 10 is shown next to a person 12 wearing a pair of in-line skates. The propulsion assembly 10 includes a drive wheel 14 that rests upon the ground. It is the rotation of the drive wheel 14 that propels both the propulsion assembly 10 and the person 12 forward. The drive wheel 14 can be of any diameter. However, a diameter of between eight inches and twenty four inches is preferred. The use of a drive wheel is preferred on paved and earthen surfaces. However, when used in snow, it should be understood that a track, such as that used on a snowmobile, can be substituted for the drive wheel.

The drive wheel 14 is rotated by an engine. The engine can be an electric motor, a diesel engine, a propane engine or the like. However, in the preferred embodiment a gasoline engine 16 is used. Although any gasoline engine 16 can be used, the gasoline engine 16 is preferably a two stroke gasoline engine that is air cooled. The gasoline engine 16 can be electrically started. However, to eliminate the weight and cost of a starter motor and battery, the gasoline engine may alternately be started by manually pulling a pull cord.

Every state has regulations regarding gasoline powered vehicles with respect to the state registration of those vehicles. In most all states, registration is not required for vehicles with gasoline motors below a predetermined size and horsepower. It is preferable that the gasoline engine of the assembly be below the state requirements for registration. However, most any sized gasoline engine can be used.

In the shown embodiment of the assembly, the gasoline engine 16 has an engine displacement of approximately 40 cubic centimeters and a horsepower rating of about 1.5 horsepower. Such power ratings are typically below the registration requirements of most states and therefore do not require registration, inspection or insurance.

Both the drive wheel 14 and the gasoline engine 16 are connected to a common frame 18. The drive wheel 14 is free rotating with respect to the frame 18 and the gasoline engine 16 is fixed to the frame 18. The drive wheel 14 is interconnected to the gasoline engine 16 in one of a variety of different ways. The drive wheel 14 can be driven by a chain that is turned by the gasoline engine 16. Alternately, the drive wheel 14 can be connected to the gasoline engine 16 with a direct gear drive, a belt drive or any other drive train system used in the prior art to connect a wheel to a gasoline engine.

The frame 18 also supports a small gas tank 20 that stores the gasoline used by the gasoline engine 16. The size of the gas tank 20 is dependent upon the size and power of the gasoline engine 16. The gas tank 20 preferably holds enough gasoline to power the gasoline engine 16 for at least one hour.

Two removable handle bars 22 extend from the frame 18. The removable handle bars 22 selectively connect to the frame 18 at a common point on the frame 18. However, once connected to the frame, the two handle bars 22 diverge away from each other as they extend from the frame 18. As such, the handle bars 22 terminate at a predetermined distance D1 apart from each other, wherein that predetermined distance D1 is between eighteen inches and three feet.

At the ends of the removable handle bars 22 are lever controls 24. The lever controls 24 engage control cables 25. On one of the handle bars 22, the lever control 24 controls the throttle of the gasoline engine 16. On the second handle bar, the lever control controls the brake.

Figure 2:
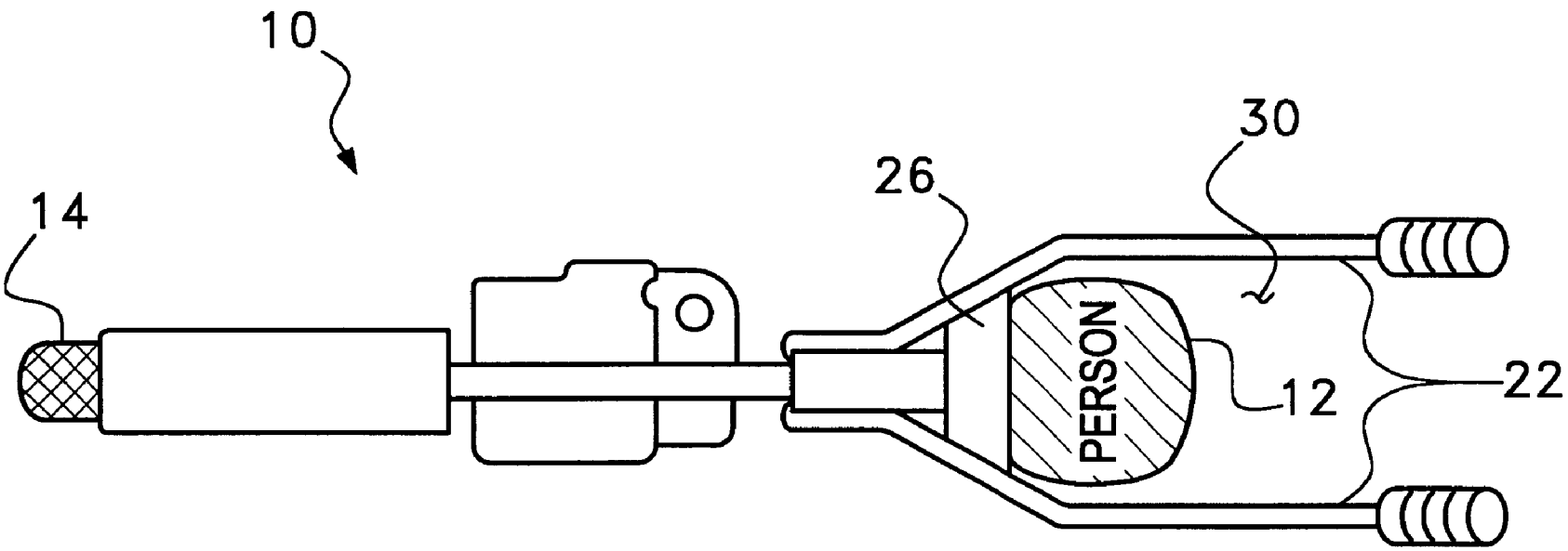
FIG. 2 is top view of the embodiment shown in FIG. 1.

In between the handle bars 22 is positioned a removable support element 26. It is the removable support element 26 that physically contacts a person and pushes a person when the assembly 10 is used. The removable support element 26 is preferably padded so as not to cause injury to a person when pressed against that person. Referring to FIG. 2, it can be seen that the removable support element 26 and the handle bars 22 define a generally U-shaped space 30. When a person 12 is utilizing the assembly 10, a person 12 stands within the U-shaped space 30. As the drive wheel 14 turns, the propulsion assembly 10 presses the support element 26 against the body of the person 12. The propulsion assembly 10, therefore propels a person forward without interfering with a person's ability to move their legs or cross their legs.

The handle bars 22 of the propulsion assembly 10 are grasped by the person using the propulsion assembly 10. The points where a person grasps the handle bars 22 are similar to the position in which a person would hold ski poles. A person can therefore turn the propulsion assembly 10 by pushing, pulling and tilting the handle bars 22. Accordingly, a person can angle the propulsion assembly 10 or cause the propulsion assembly 10 to contact the back of the person at different angles. This provides great agility and steerability to the propulsion assembly 10 that is unavailable in the prior art.

Returning to FIG. 1, it can be seen that a removable secondary support element 32 extends from the frame 18 to the center of the first support element 26. The secondary support element 32 may contact a person's back if a person holds the propulsion assembly 10 at a particularly steep angle of inclination. Since the secondary support element 32 may contact the person using the propulsion assembly 10, the secondary support element 32 is also preferably padded.

When a person utilizes the propulsion assembly 10, they stand in between the handle bars 22. Once the throttle on the handle bar 22 is activated, the gasoline engine 16 powers the drive wheel 14. The turning of the drive wheel 14 propels the propulsion assembly 10 forward and biases the propulsion assembly 10 against the back of the person 12. Depending upon the angle at which the propulsion assembly 10 is held, either the support element 26 contacts the back of the person 12 or both the support element 26 and the secondary support element 32 contact the person 12. As the propulsion assembly 10 biases the support element 26 against the back of the person 12, the person 12 is propelled forward.

People on skates, skateboards, skis and the like often fall. To prevent the propulsion device from accidentally running over a fallen person, the propulsion device comes with a safety shut off. The safety shut off is a kill switch that automatically stops the gasoline engine 16. The kill switch is activated when a tethered clip 34 is pulled from a connector port on the propulsion assembly 10. The tethered clip 34 attaches to a person utilizing the propulsion assembly 10. Consequently, if a person falls while using the propulsion assembly 10, the tethered clip 34 will be pulled from the assembly and the gasoline engine 16 will automatically stop.

The present invention propulsion assembly 10 also comes with a retractable tow cord 36. The tow cord 36 is attached to the rear of the frame 18. The tow cord 36 can be held by another skater, skier, skateboarder or the like, thereby enabling the propulsion device 10 to simultaneously propel at least two different individuals.

Figure 3:
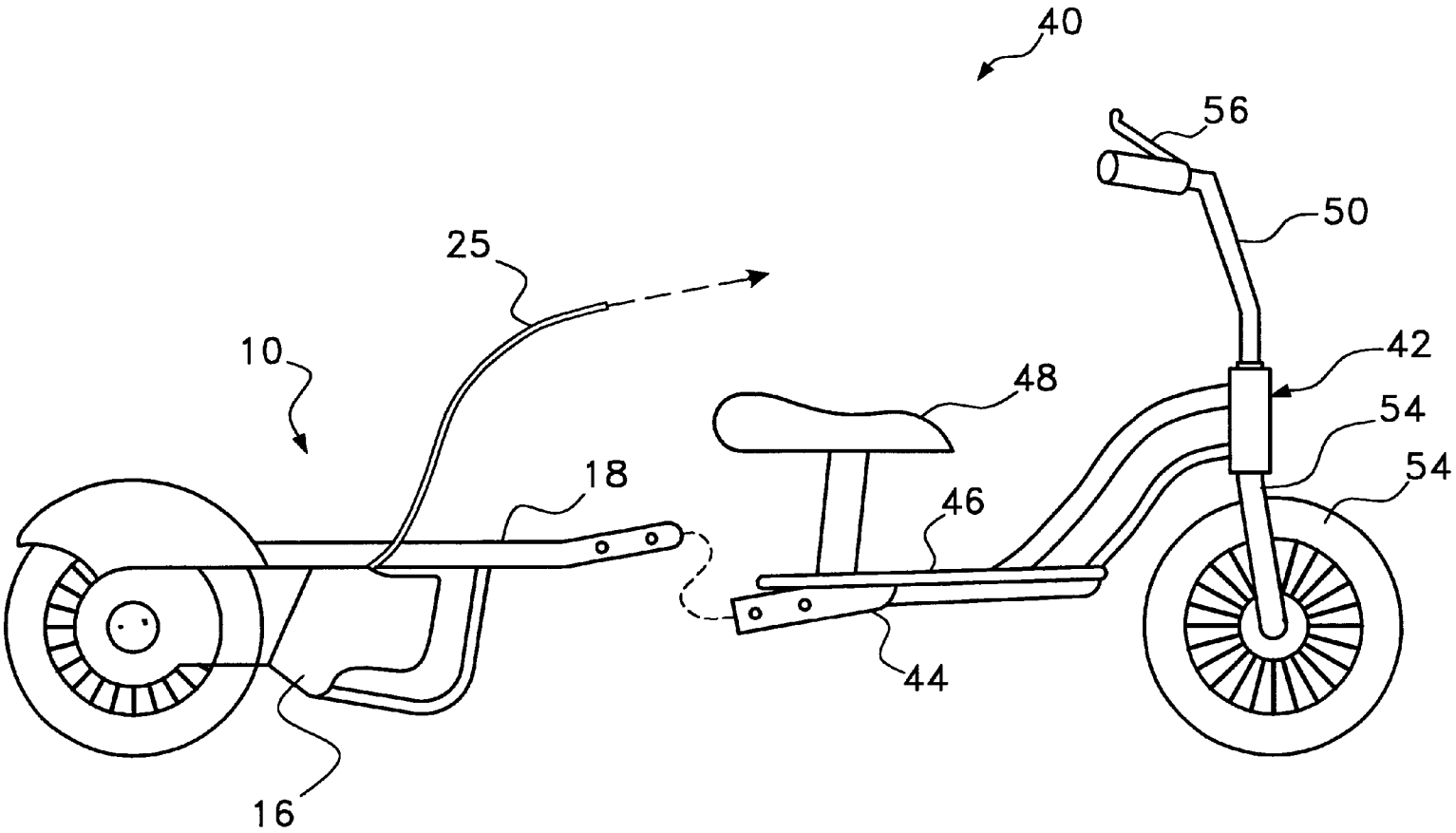
FIG. 3 is a side view of both a rear propulsion device and an exemplary cycle front-end subassembly.

Referring to FIG. 3, an alternate embodiment of the present invention assembly 40 is shown. In this embodiment, the handle bars 22 (FIG. 1), first support element 26 (FIG. 1) and second support element 32 (FIG. 1) of the previously described propulsion device 10 are removed from the front of the frame 18. A cycle front-end subassembly 42 is then attached to the frame 18, thereby creating a motorized two-wheel cycle assembly.

The cycle front-end subassembly 42 contains a secondary frame 44 that attaches to the primary frame 18 of the propulsion device 10 using mechanical fasteners, such as pins, bolts or the like. The secondary frame 44 of the cycle front-end subassembly supports a foot platform 46, a seat 48, a set of cycle handle bars 50 and a front fork element 52. A front wheel 54 mounts to the front fork element, thereby providing the overall assembly with two wheels.

Once the cycle front-end subassembly 42 is mounted to the frame 18 of the propulsion device 10, a motor scooter is created. A person can sit on the seat 48 and place his/her feet on the foot platform 46. The motor scooter is steered by moving the handle bars 50. The control cables 25 extending from the gasoline engine 16 are attached to control levers 56 on the handle bars 50. As such, a person riding the motor scooter can control the operations of the engine from the handle bars 50.

Figure 4:
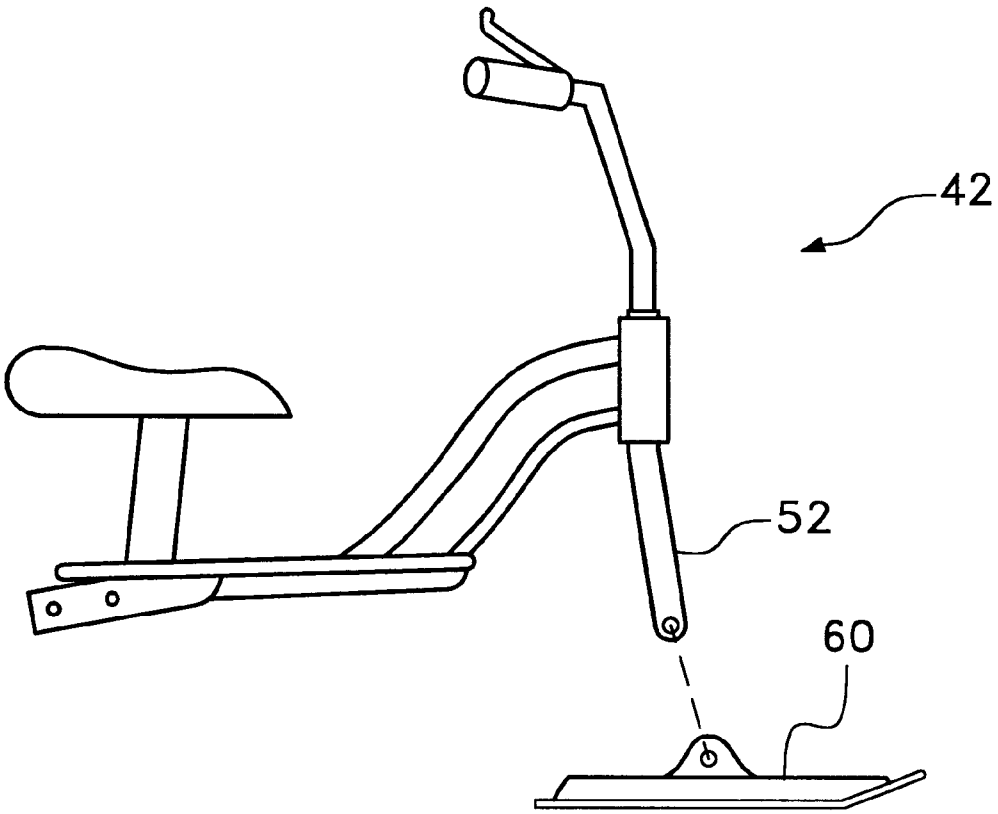
FIG. 4 is a side view of the cycle front-end subassembly of FIG. 3 shown with a ski element substituted for the front wheel.

Referring to FIG. 4, it can be seen that the front wheel 54 (FIG. 3) of the cycle front-end subassembly 42 can be replaced with a ski 60. The ski 60 mounts to the front fork element of the cycle front-end subassembly in place and stead of the previously described wheel. In this configuration, the overall assembly is configured to ride on snow, wherein the front ski 60 is used to steer through the snow.

Figure 5:
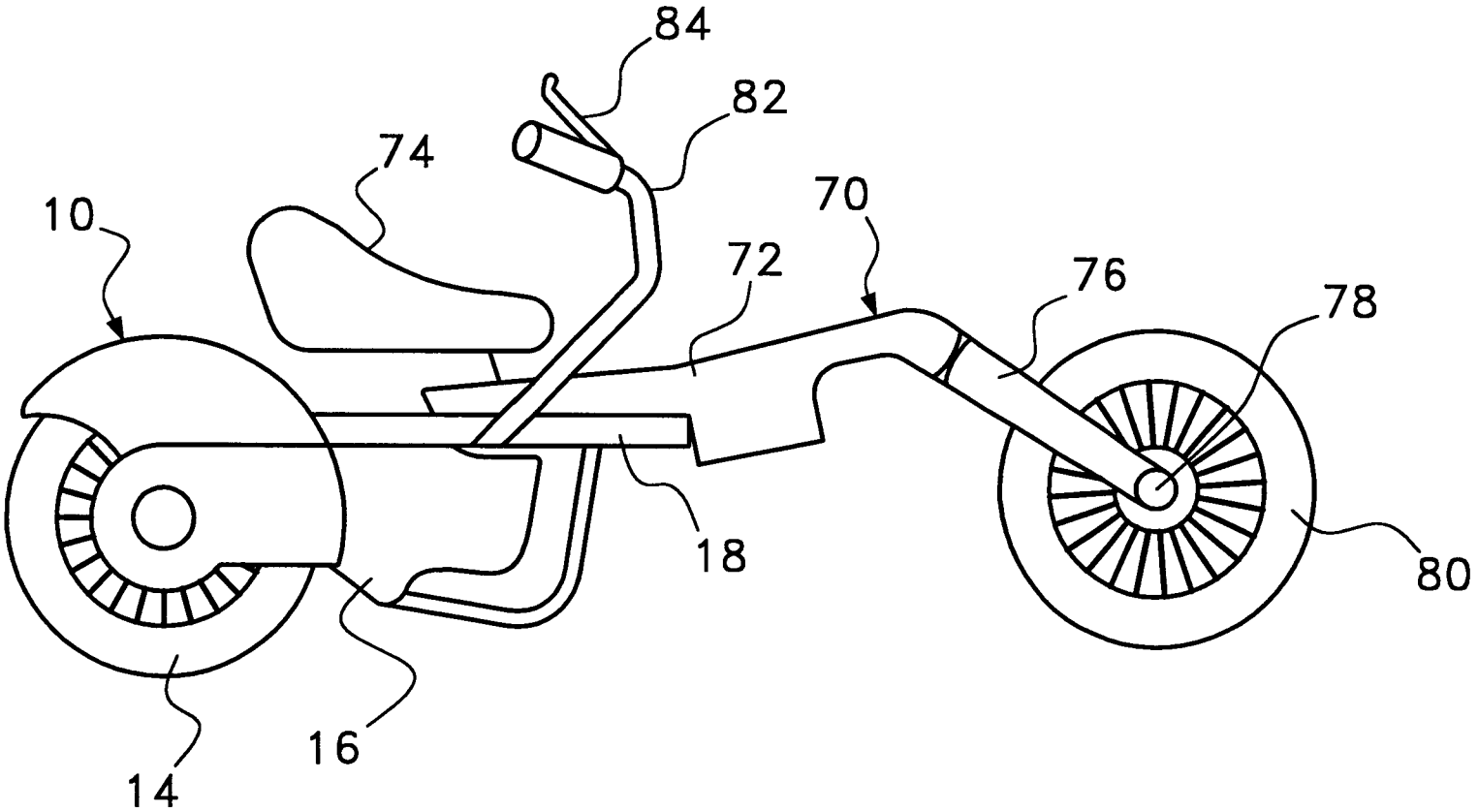
FIG. 5 is a side view of both a rear propulsion device and an exemplary recumbent cycle front-end subassembly.

In the embodiments of FIG. 3 and FIG. 4, the seat is positioned in the middle of the overall assembly. This seat position enables a person to sit upright and hold onto the handle bars to steer. Referring now to FIG. 5, an alternate embodiment of the present invention is shown. In this embodiment a recumbent cycle front-end subassembly 70 is shown. The recumbent cycle front-end subassembly 70 has a frame 72 that also selectively attaches to the frame 18 of the original propulsion device 10. The frame 72 of the recumbent cycle front-end subassembly 70 supports a seat 74 above the propulsion device 10 between the engine 16 and the rear drive wheel 14. The frame 72 of the recumbent cycle front-end subassembly 70 also supports a fork element 76 in front of the propulsion device 10. Foot supports 78 extend horizontally from opposite sides of the fork element 76. When a person sits on the seat 74, that person's feet rest upon the foot supports 78. By pressing the foot supports 78 with a person's feet, the orientation of the fork element 76 can be changed. Thus a person can use his/her feet to steer the overall assembly.

The fork element 76 supports either a front wheel 80 (shown) or a front ski (not shown), depending upon the intended terrain.

In the embodiment of FIG. 5, a person sitting in the assembly must be able to control the engine 16 and the brakes of the recumbent vehicle. For this purpose, two handle bars 82 can be mounted to the assembly so that the handle bars 82 extend on either side of the seat 74. On the handle bars 82 are positioned the control levers 84 that are used to control the engine and brakes.

It will be understood that the embodiments of the present invention system described and illustrated herein are merely exemplary and a person skilled in the art can make many variations to the embodiment shown without departing from the scope of the present invention. For example, the prior art is replete with different types of gasoline engines, transmissions and braking systems. Any such prior art devices can be adapted for use in the present invention. All such variations, modifications and alternate embodiments are intended to be included within the scope of the present invention as defined by the appended claims.

What is claimed is:

1. A modular motor vehicle system, comprising:

a rear propulsion assembly containing:

a first frame;

an engine supported by said first frame;

a single drive wheel supported by said first frame and coupled to said engine, wherein said engine selectively drives said drive wheel; and a handle bar assembly containing:

a set of handle bars;

at least one support element coupled to said set of handle bars; and a front-end assembly containing;

a second frame;

a foot platform supported by said second frame;

a seat supported by said second frame;

a steering fork element supported by said second frame;

a single ground engagement element connected to said steering fork element, wherein said ground engagement element is selected from a group consisting of a wheel and a ski;

a steering mechanism extending from said steering fork element;

wherein said first frame of said rear propulsion assembly is selectively connectable with said handle bar assembly to produce a single wheel personal propulsion device and said first frame of said rear propulsion assembly is selectively connectable with said second frame of said front-end assembly to form a passenger supporting vehicle that rides only on said drive wheel and said ground engagement element.

2. The system according to claim 1, wherein said ground engagement element is a wheel and said first frame of said rear propulsion assembly and said second frame of said front-end assembly are selectively attachable to form a two-wheeled vehicle.

3. The system according to claim 1, wherein said ground engagement element is a ski and said first frame of said rear propulsion assembly and said second frame of said front end assembly are selectively attachable to form a vehicle having a single wheel and a single ski.

4. The system according to claim 1, wherein said steering mechanism is selected from a group consisting of foot pedals and handle bars.

5. The system according to claim 1, wherein said steering mechanism includes a set of handle bars attached to said steering fork element.

6. The system according to claim 1, wherein said steering mechanism includes a set of foot supports extending horizontally from opposite sides of said steering fork element.

7. A modular vehicle having a selectively convertible form, comprising:

a rear propulsion assembly having a motor, a single rear wheel that is driven by the motor and a first frame for supporting said rear wheel and said motor;

a handle bar assembly containing handle bars and a support element that interconnects said handle bars; and a front-end assembly containing a single front wheel, a seat, a foot platform, a steering mechanism and a second frame that supports said front wheel, seat, foot platform and steering mechanism;

wherein the first frame of said rear propulsion assembly is selectively connectable to said handle bar assembly to form a single wheeled personal propulsion vehicle, and wherein the first frame of said rear propulsion assembly is selectively connectable to the second frame of said front-end assembly to form a two-wheeled vehicle which is supported only by said front wheel and said rear wheel.

* * * * *